US008720354B2

(12) United States Patent
Ketterman et al.

(10) Patent No.: US 8,720,354 B2
(45) Date of Patent: May 13, 2014

(54) QUADFOILER

(75) Inventors: Gregory Scott Ketterman, Oceanside, CA (US); James Taylor Czarnowksi, Fallbrook, CA (US); Jason Christopher Kardas, Vista, CA (US); Philip James Dow, Oceanside, CA (US)

(73) Assignee: Hobie Cat Co., Oceanside, CA (US)

( * ) Notice: Subject to any disclaimer, the term of this patent is extended or adjusted under 35 U.S.C. 154(b) by 111 days.

(21) Appl. No.: 13/524,655

(22) Filed: Jun. 15, 2012

(65) Prior Publication Data

US 2012/0325135 A1 Dec. 27, 2012

Related U.S. Application Data

(60) Provisional application No. 61/499,870, filed on Jun. 22, 2011.

(51) Int. Cl.
*B63B 35/00* (2006.01)

(52) U.S. Cl.
USPC ..... 114/39.24; 114/61.1; 114/273; 114/274

(58) Field of Classification Search
USPC ..... 114/39, 39.24, 61.1, 274
See application file for complete search history.

(56) References Cited

U.S. PATENT DOCUMENTS

| | | | | | |
|---|---|---|---|---|---|
| 3,598,076 | A * | 8/1971 | Saxton | 114/274 |
| 3,726,245 | A * | 4/1973 | Critcher | 114/61.1 |
| 3,802,366 | A * | 4/1974 | Mankawich | 114/39.24 |
| 4,027,614 | A * | 6/1977 | Jones | 114/163 |
| 4,228,750 | A | 10/1980 | Smith et al. | |
| 4,615,291 | A * | 10/1986 | Jones | 114/280 |
| 4,981,099 | A * | 1/1991 | Holder | 114/274 |
| 5,054,410 | A * | 10/1991 | Scarborough | 114/39.26 |
| 5,168,824 | A * | 12/1992 | Ketterman | 114/276 |
| 5,309,859 | A * | 5/1994 | Miller | 114/274 |
| 5,673,641 | A * | 10/1997 | Sournat et al. | 114/39.11 |
| 6,024,041 | A * | 2/2000 | Eglais | 114/274 |
| 6,578,507 | B1 * | 6/2003 | Bergmark | 114/39.24 |
| 6,675,735 | B1 * | 1/2004 | Bourn | 114/273 |
| 6,729,258 | B1 * | 5/2004 | Fuglsang et al. | 114/61.1 |
| 6,883,450 | B2 * | 4/2005 | Kingsbury | 114/61.1 |
| 7,568,442 | B2 * | 8/2009 | Kruppa | 114/102.1 |
| 7,568,443 | B2 * | 8/2009 | Walker | 114/162 |
| 7,637,221 | B1 * | 12/2009 | Sinden | 114/90 |
| 7,644,672 | B2 * | 1/2010 | Welbourn | 114/39.24 |
| 7,699,262 | B2 * | 4/2010 | Filipek | 244/105 |
| 7,743,720 | B1 * | 6/2010 | Salani | 114/61.1 |
| 8,069,801 | B2 * | 12/2011 | Ott et al. | 114/102.29 |
| 8,109,221 | B2 * | 2/2012 | Graf et al. | 114/61.2 |
| 8,210,114 | B2 * | 7/2012 | Nysether et al. | 114/162 |
| 8,408,155 | B2 * | 4/2013 | Sancoff et al. | 114/282 |
| 2002/0096098 | A1 * | 7/2002 | Kingsbury | 114/61.1 |
| 2012/0048165 | A1 * | 3/2012 | Westerman | 114/126 |
| 2012/0325135 | A1 * | 12/2012 | Ketterman et al. | 114/39.24 |

* cited by examiner

*Primary Examiner* — S. Joseph Morano
*Assistant Examiner* — Jovon Hayes
(74) *Attorney, Agent, or Firm* — Joseph E. Mueth, Esq.

(57) ABSTRACT

A watercraft having a hull, a mast with sail, an aft rudder and a hydrofoil projecting below the bottom of the hull. The hydrofoil is pivotly connected to the hull enabling the hydrofoil to pitch on a pivot axis which is essentially perpendicular to the longitudinal axis of the hull. The hydrofoils have a vertical part which produces lateral forces to accelerate the boat in turns and resist lateral forces from the sail, and a vertical portion which curves into the horizontal portion which produces vertical lift. The angle of incidence of the hydrofoil is controlled by a sensor arm carrying a trailing sensor.

10 Claims, 8 Drawing Sheets

QUADFOILER

This patent application claims the benefit of the filing date of U.S. Provisional Patent Application Ser. No. 61/499,870, filed Jun. 22, 2011, the disclosure of which is incorporated herein by reference.

FIELD OF THE INVENTION

This invention relates to the control of the angle of attack of hydrofoils on boats.

BACKGROUND OF THE INVENTION

Boats have used hydrofoils for many years as it is known that hydrofoils can reduce the drag of a hull going through the water and they can provide a smoother ride. There have been many variations of methods to control the ride height of the boat. All hydrofoil boats need some mechanism to make the boat fly at the right height above the water. Most of the mechanisms fall into one of two categories:

1. Incidence controlled has some mechanism that controls the angle of attack of the hydrofoil so that it keeps the boat at the right height.
2. Surface piercing foils control the lift generated by the foils by constantly varying the amount foil available in the water to provide lift. The foil pierces the surface of the water at an angle so that as the boat rises up there is less foil in the water and eventually the boat finds equilibrium.

Surface piercing has the benefit of simplicity and potentially the ability to have the optimum amount of foil in the water, but incidence control has the following benefits:

1. The foil pierces the surface at an angle close to 90 degrees which produce less drag and spray and the foil is less susceptible to ventilation.
2. In rough water incidence controlled has more authority to lift the boat up and down quickly with the waves.
3. In the case of a sailboat the weather foil has the ability to pull down and keep the boat level regardless of the wind strength.

Two examples of surface piercing are:

1. Sournat, et. al., U.S. Pat. No. 5,673,641.
2. Bernard Smith, U.S. Pat. No. 4,228,750.

Ketterman, U.S. Pat. No. 5,168,824 and Clyde Jones hydrofoil catamaran U.S. Pat. No. 4,615,291 are both incidence controlled. In these two designs the strut and the hydrofoil are one solid foil and this whole foil pitches up and down to change angle of incidence, but the foil pivots about a point that is well above the foil and well above the water surface. This means that the lift vector and the drag vector generated by the hydrofoil are some distance away from the pivot and they create pitching moments on the hydrofoil. Also the predominate force, the lift vector, moves fore and aft as the hydrofoil pitches up and down which changes the pitching moments dramatically on the hydrofoil.

There are many designs that use a flap on the trailing edge of the hydrofoil to adjust lift which would be an example of an incidence controlled hydrofoil. This design is less efficient than a design where the whole hydrofoil pitches.

Incidence controlled hydrofoils typically have some type of sensor to sense the ride of the boat. The Ketterman patent hydrofoil uses a forward facing sensor which works well, but the sensors are well in front of the boat which are vulnerable and add considerable length to the boat.

SUMMARY OF INVENTION

A watercraft having a mast with sail comprising a hull having an aft rudder and a hydrofoil projecting below the bottom of the hull at each side of the hull, said watercraft further comprising means pivotally connecting each hydrofoil to the hull enabling the said hydrofoil to pitch on a pivot axis which is essentially perpendicular to the longitudinal axis of the hull such that when hydrofoil pitches the moments on the hydrofoil are small, said hydrofoils having a vertical part which produces lateral forces to accelerate the boat in turns and resist lateral forces from the sail, and a vertical portion which curves into the horizontal portion which produces vertical lift, and means to cause the hydrofoil to pitch up when the watercraft is closer to the water surface and to pitch down when the watercraft gains altitude.

In a preferred embodiment, a catamaran with mast and sail comprising two spaced apart hulls, a deck extending therebetween, each hull having an aft rudder and a hydrofoil projecting below the bottom of the hull, said catamaran further comprising means pivotally connecting each hydrofoil to each hull of the catamaran enabling the said hydrofoil to pitch on a pivot axis which is essentially perpendicular to the longitudinal axis of the hull such that when hydrofoil pitches the moments on the hydrofoil are small, said hydrofoils having a vertical part which produces lateral forces to accelerate the boat in turns and resist lateral forces from the sail, and a vertical portion which curves into the horizontal portion which produces vertical lift, means controlling the angle of incidence of the hydrofoil comprising a sensor arm carrying a trailing sensor, said sensor arm being carried on a pivot in proximity to the fore end of the hull, said sensor being pinned to said sensor arm and dragged behind the pivot, whereby the sensor is constrained to stay in contact with the water surface, and means connecting said sensor arm to said hydrofoil whereby when the hull is low in the water the sensor arm is constrained to pitch down, and when the hull is too high, the sensor arm pitches up.

The angle of incidence control system for hydrofoils for boats having hull and a deck comprising:

a hydrofoil, means connecting said hydrofoil to the hull of the boat enabling the said hydrofoil to pitch on an axis such that when hydrofoil pitches the moments on the hydrofoil are small. For example the pivot axis is very close to the lift and drag vectors acting on the hydrofoil through out the range of pitching motion of the hydrofoil.

The hydrofoils in this invention have two parts—the vertical part produces lateral forces to accelerate the boat in turns and resist lateral forces from the sail. The vertical portion curves into the horizontal portion which produces vertical lift. The angle of incidence control system is controlling the angle of incidence of the horizontal portion and thus the vertical lift.

In the present invention in which the angle of incidence system for the hydrofoil enables the pivot axis to be located near the lift and drag vectors acting on the hydrofoil, the hydrofoil rolls on a circular track. The center of the circle defines the pivot axis. The top of the hydrofoil is connected to two wheels that roll on the track. The two wheels are spaced apart so that the track constrains the pitch angle or the angle of incidence of the hydrofoil. As the wheels roll on the track the hydrofoil is constrained to pitch up or down with the curvature of the track.

The hydrofoil has vertical and horizontal loads on it and thus the wheels are able to constrain the hydrofoil in the vertical and lateral direction with out creating significant friction. Near the bottom of the hull the hydrofoil is constrained in the lateral direction by rollers which roll on smooth surfaces inside the dagger board well inside the hull in a generally circular, arcuate path.

Preferably, the angle of incidence of the hydrofoil is controlled by a trailing wand type sensor arm—the sensor is being dragged behind the pivot. The sensor arm is pivotally attached to the hull and the aft end of the sensor arm is constrained to stay in contact with the water surface. If the hull is low in the water the sensor arm is constrained to pitch forward or down. A tension line, sensor line, is attached to the top of the sensor arm and travels back aft of the hydrofoil and rounds a turning block and goes forward. It terminates at the top of the hydrofoil and so when the sensor arm pitches down the hydrofoil pitches up and conversely if the sensor arm pitches up, the boat is too high, the hydrofoil is allowed to pitch down and the angle of attack and the lift generated by the hydrofoil is reduced. Equilibrium is achieved when the altitude is correct. The steady state altitude can be adjusted by adjusting the length of the sensor line or by moving the turning block fore and aft.

The location of the pivot axis is chosen so that the sum of the moments on the hydrofoil is always acting to pitch the foil down slightly. This will ensure that there is always tension in the sensor line and the aft end of the sensor arm is in contact with the water. If the right balance is not achieved and there is too much tension in the sensor line or the sensor does not stay in contact with the water, too little tension in the sensor line, a spring force or shock cord force can be used to compensate in either direction.

In a preferred embodiment, a small planing surface is pivotally attached to the aft end of the sensor arm which provides efficient planing lift to the sensor arm.

As with the suspension system of an automobile which filters out the high frequency small bumps in the road the incidence control system of the hydrofoil filters out high frequency small waves on the water surface. A combination of a spring in series with the sensor line and a dampener on the hydrofoil will prevent small waves from affecting the hydrofoil. The flexibility of the system can be represented with a spring in series with the sensor line, but in reality many of the components will contribute to the flexibility including the sensor arm, sensor line and the hull.

If the pitching moments on the hydrofoil remain low, the loads on the sensor remain low. It is important that the loads on the sensor remain low because:

1. The sensor will produce less drag.
2. If there is a spring in series with the sensor line to filter out high frequency inputs, this spring will be stretched and the boat will ride lower if the load on the sensor is high.
3. The sensor will be able to pass over troughs in the waves which is an effective way to filter out high frequency inputs.

For beaching, storing and transporting it is important to be able to remove the hydrofoils from the hulls. The hydrofoils can be unbolted from the wheels, disconnected from the dampener and sensor line and then the hydrofoil can be lifted up and out of the hull.

The dagger board well is enlarged to accommodate the curved portion of the hydrofoil.

In another embodiment the hydrofoil rotates about a pin near the bottom of the hull. A wheel with rollers is attached to the top of the hydrofoil and the wheels rolls in a circular track. The wheel resists side loads and vertical loads so the hydrofoil is free to pitch up and down. There are two rollers attached to the hydrofoil near the bottom of the hull that allow the hydrofoil to pitch up and down, but not yaw.

When the sensor line is pulled the hydrofoil pitches up. When the hydrofoil pitches up there is a positive pitching moment applied to the hydrofoil because the lift vector from the hydrofoil moves forward of the pivot. This positive pitching moment will cause the sensor line to go slack and the system will fail as the boat will ride too high. To counter act this positive pitching moment a spring is attached near the top of the hydrofoil and when the hydrofoil pitches up the spring is stretched and produces a negative pitching moment which will maintain tension in the sensor line.

Hydrodynamic drag on the hydrofoil will create a negative pitching moment and too much tension in the sensor line at high speed. The sensor will be pressed into the water and create excessive drag. To counter act this negative pitching moment a hydraulic cylinder is attached to the top of the hydrofoil and pulls aft on the hydrofoil producing a positive pitching moment. The hydraulic cylinder is driven by water pressure from a pitot tube in the hydrofoil. The positive pitching moment of the hydraulic cylinder will match the negative pitching moment produced by hydrodynamic drag of the hydrofoil.

The negative pitching moment produced by the spring needs to be adjusted depending upon how much lift is generated by the hydrofoil which will vary depending on weight in the boat, strength of the wind and apparent wind direction. The spring could be eliminated and the need to adjust the spring if the pivot point could be moved forward at the same rate the lift vector moves forward. This is done by decreasing the radius of curvature of the circular track in the aft section of the track so that the wheels are essentially riding up a ramp as the hydrofoil pitches up and begins producing lift. This essentially moves the pivot point forward as the lift vector moves forward and the pitching moment on the hydrofoil remains nearly zero. As the hydrofoil pitches up the hydrofoil begins moving down relative to the hull. The wheels in the hydrofoil near the bottom of the hull are able to roll down the hull, but as the hydrofoil pitches up the wheels will want to roll in a direction slightly forward of vertical. The pin in the hydrofoil near the bottom of the hull moves in a vertical track in the dagger board well. This vertical track curves forward near the bottom and guides the wheels forward to roll without sliding sideways.

The main objective of this invention is to control the angle of incidence of the hydrofoil with as little force as possible and to use a trailing wand sensor to make the sensor less vulnerable. Since the pivot axis can be placed at the center of forces, the sum of the moments on the hydrofoil are small and the force required to pitch the foil up and down is small.

A further benefit of the invention is it will be easy to adjust the ride height of the boat by simply adjusting the length of the sensor line or moving the turning block fore and aft.

It will be easy to adjust the frequency response of the hydrofoil by simply adjusting the spring rate of the spring in series with the sensor line.

This design allows the hydrofoils to be removed from the boat in manner similar to the way conventional sailboats remove dagger boards and center boards.

Another benefit is that the hydrofoil can be designed with a break away in case the hydrofoil hits something at high speed. In that case the hydrofoil can break away from the two wheels, the sensor line, and the dampener and can rotate and be pulled out of the bottom of the hull. The hydrofoil is tethered to the boat for retrieval.

THE DRAWINGS

Figure 1:
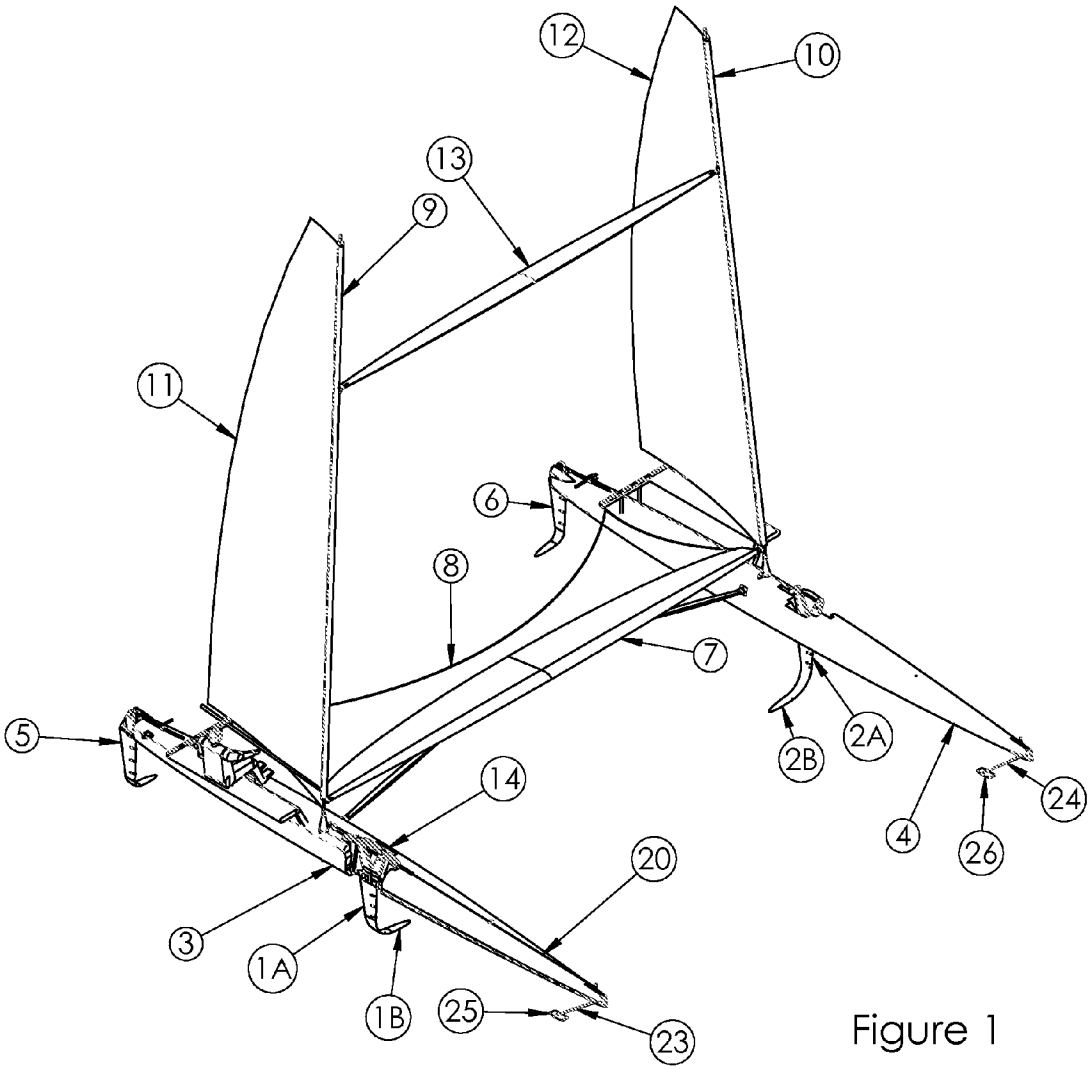
FIG. 1 shows an isometric view of hydrofoil catamaran sailboat of this invention using the angle of incidence control system for hydrofoils.
Figure 2:
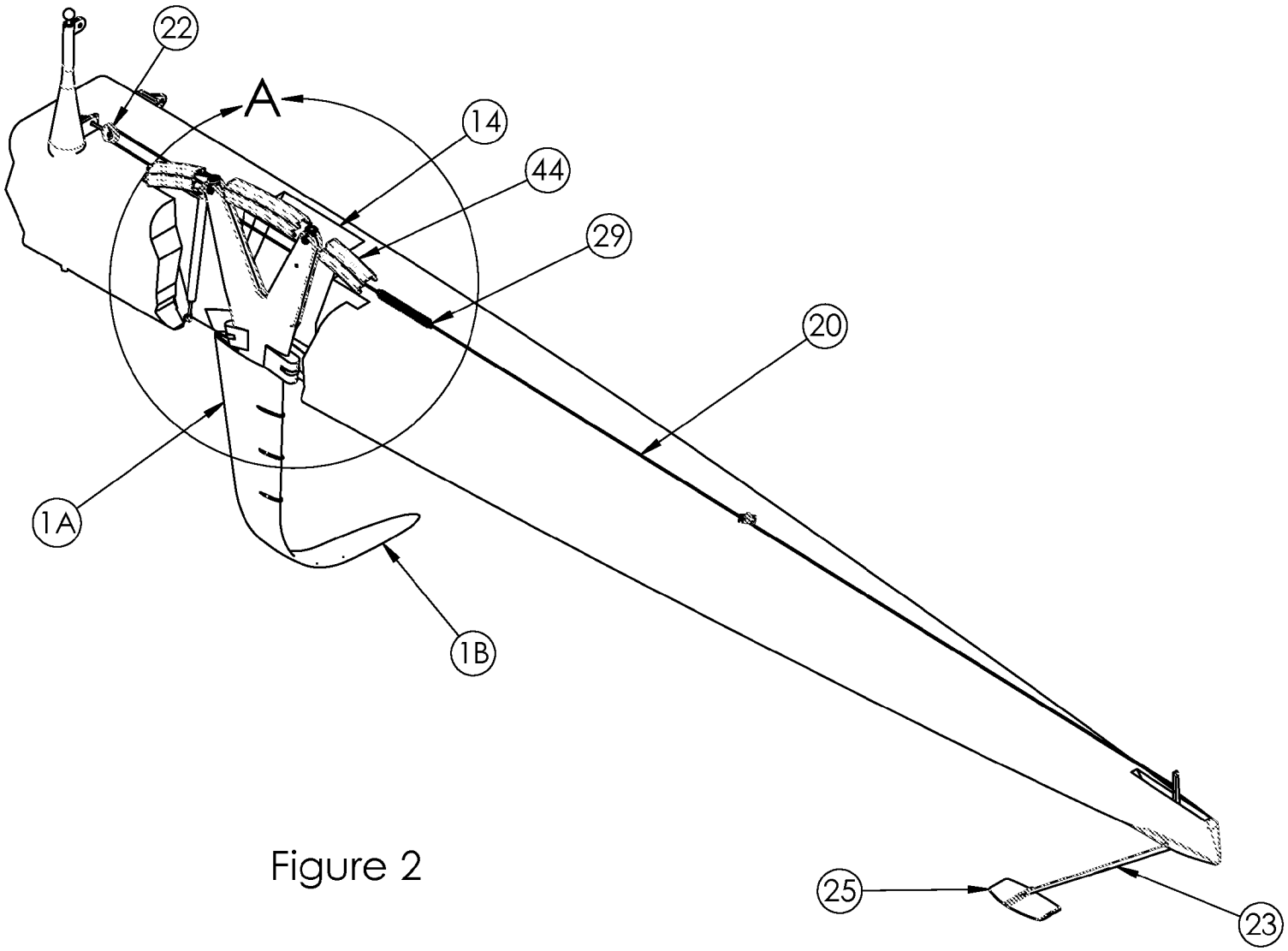
FIG. 2 shows an isometric view of the bow of the starboard hull showing the hydrofoil, the sensor and the sensor line.
Figures 3, 4:
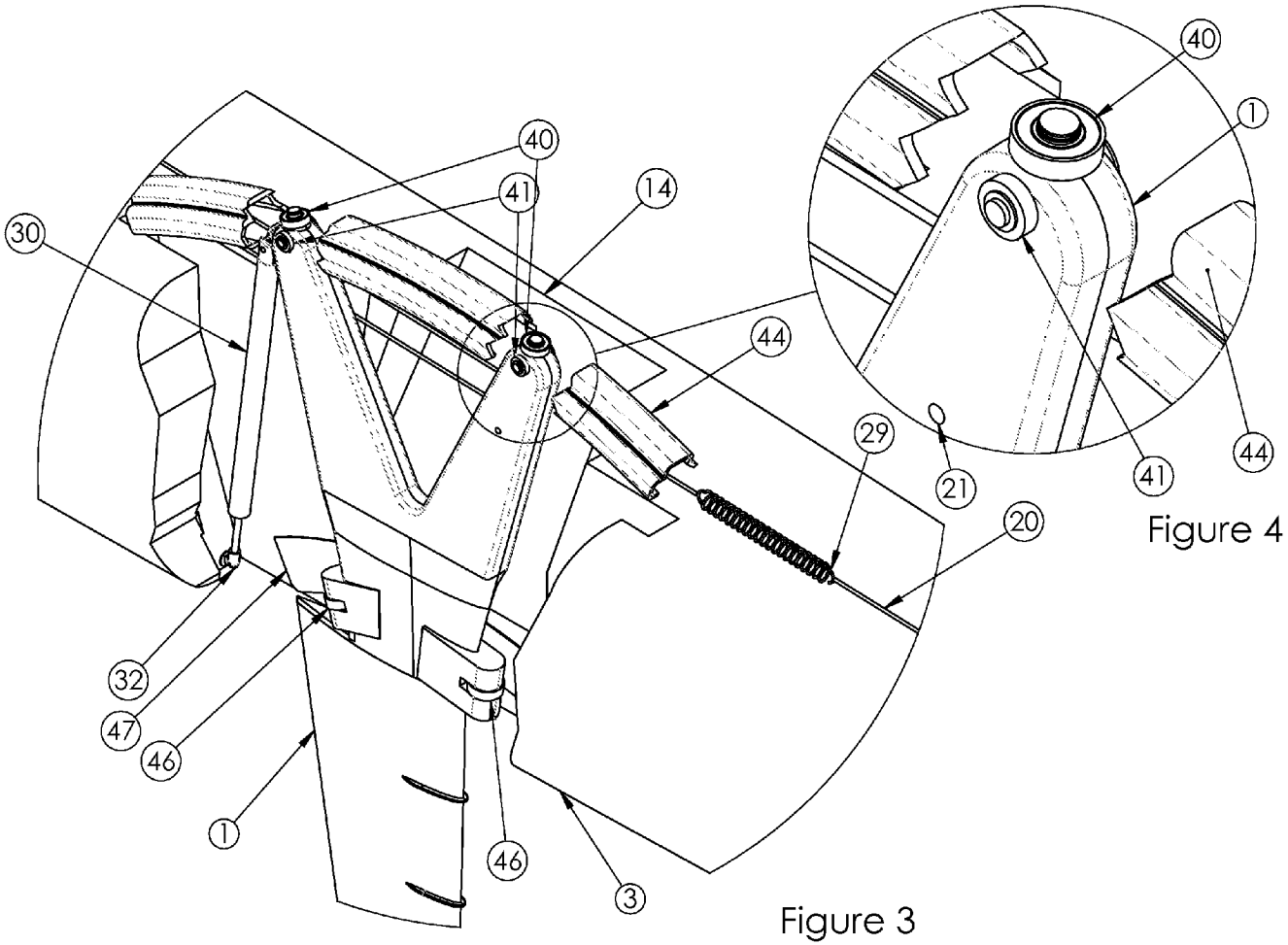
FIG. 3 shows an isometric view of the hydrofoil with the hull cut away to show the hydrofoil and rollers.
FIG. 4 show an expanded view of the car and wheels on the hydrofoil.
Figure 5:
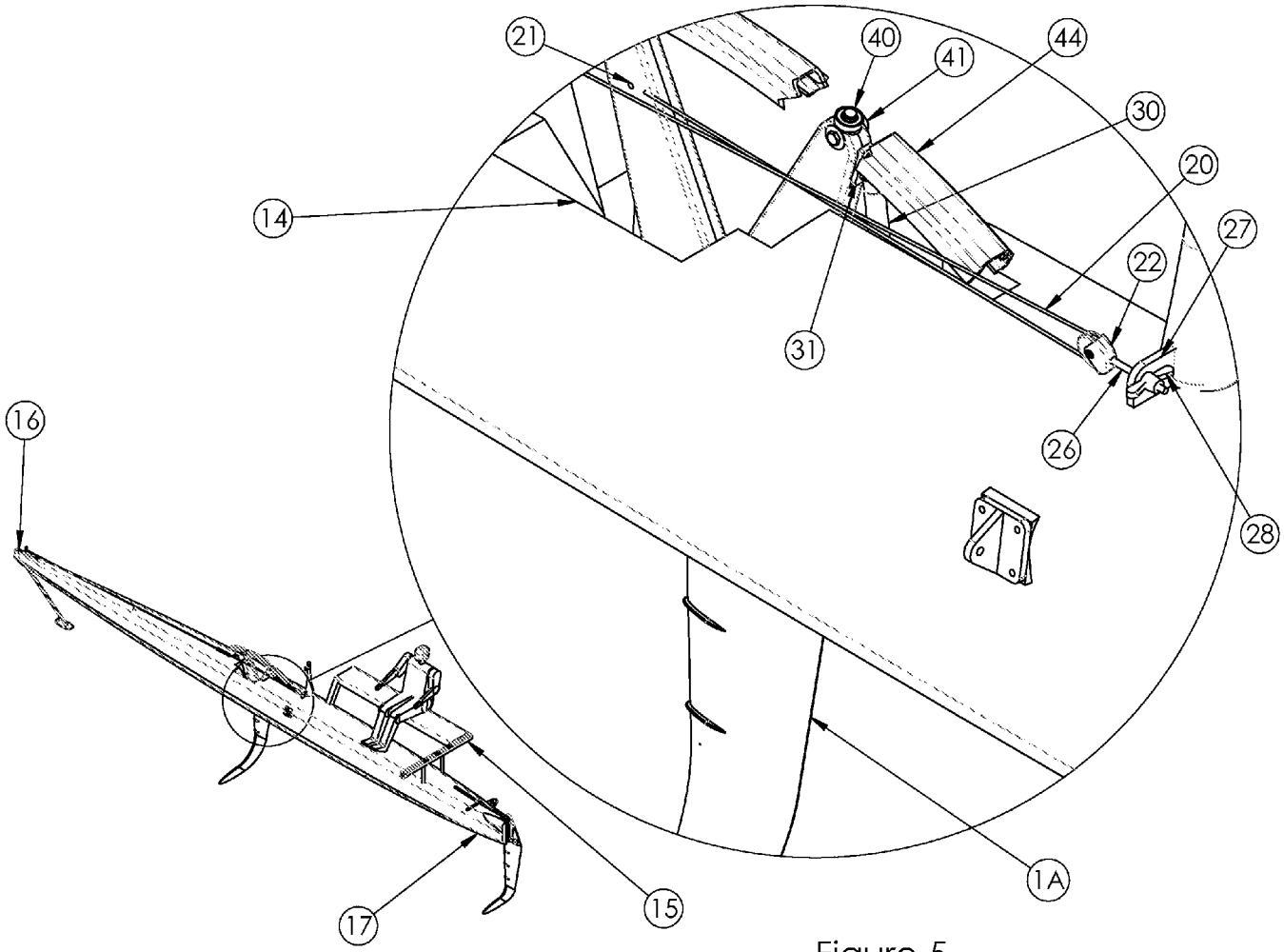
FIG. 5 shows an isometric view of the inboard back side of the hydrofoil.

While the invention as shown in the drawings illustrates its application of a catamaran, those skilled will appreciate that this invention is applicable to single hull watercraft as well as to trimarans.

DESCRIPTION OF THE PREFERRED EMBODIMENTS

Considering the drawings in more detail, hydrofoils 1 and 2 are mounted inside a dagger board well 14 in hulls 3 and 4. The hydrofoils have a vertical portion 1A and 2A and a horizontal portion 1B and 2B. Sensor arms 23 and 24 are pinned to the bows 16 of each hull 3 and 4. The rudders 5 and 6 are pinned to stern 17 of each hull 3 and 4. The main beam 7 is the main structural component connecting hulls 3 and 4. The trampoline 8 is attached to the main beam 7 and is stretched between the hulls 3 and 4. The masts 9 and 10 support the sails 11 and 12. The compression strut 13 supports the mast 9 and 10. The top surface of the hull includes space 15 to carry a rider.

The sensor line 20 is attached to the hydrofoil 1 at the hole 21. The sensor line 20 leads aft and passes around the turning block 22 and then leads forward. The sensor line 20 terminates at the top end of the sensor arm 23. The spring 29 is in series with the sensor line 20. The sensor arm 23 is pinned to the bow of hull 3. A small planing surface 25 is pinned to the lower end of the sensor arm 23.

The turning block 22 is attached to a threaded rod 26 which passes through a bracket 27 and is secured with a wing nut 28. The ride height of the boat is adjusted by turning this wing nut 28 which move the turning block 22 fore and aft.

Dampener 30 is pinned to bracket 31 which is fixed to hydrofoil 1. Dampener 30 is attached to the hull 3 through connector 32.

The top of hydrofoil 1 has 2 wheels 40 for taking lateral loads and 2 wheels 41 for taking vertical loads which roll on track 44.

The hydrofoil 1 has two wheels 46 to resist lateral loads located near the bottom of the hull 3. One wheel is ahead of the hydrofoil 1 and one wheel is behind the hydrofoil 1. Aluminum plates 47 are bonded to both sides of the inside of the dagger board well 14 for the wheels 46 to roll on.

Figure 6:
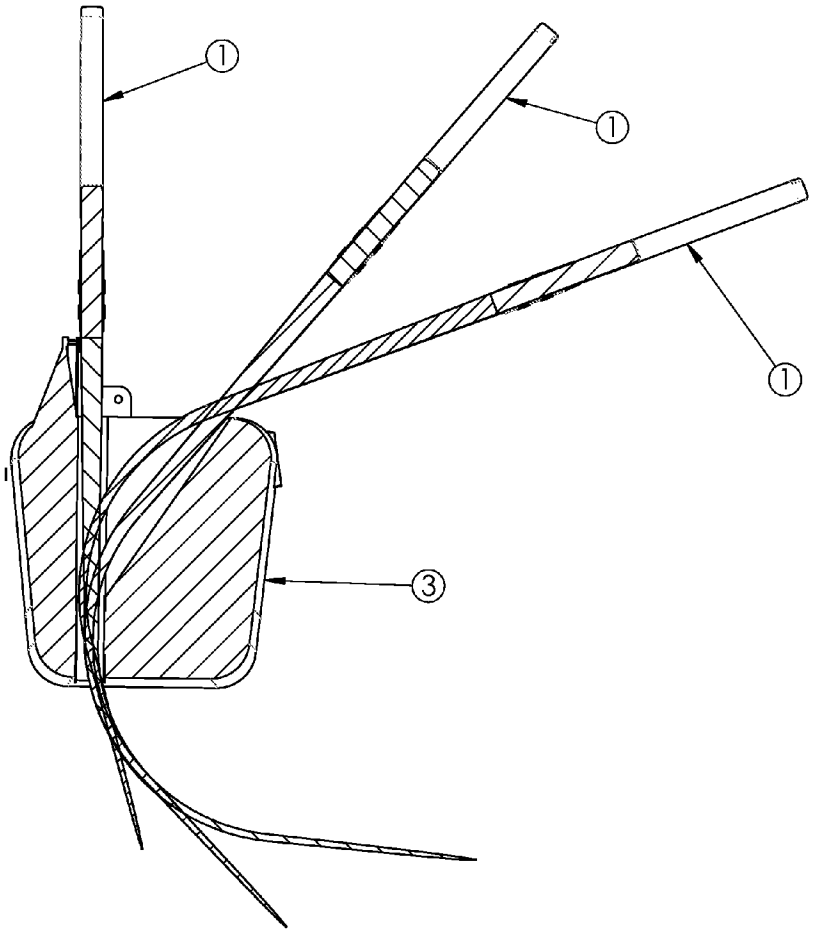
FIG. 6 shows a sectional view of the hull through the hydrofoil to show how the foil is removed from the hull.

FIG. 6 shows how the hydrofoil 1 is removed from hull 3.

Figure 7:
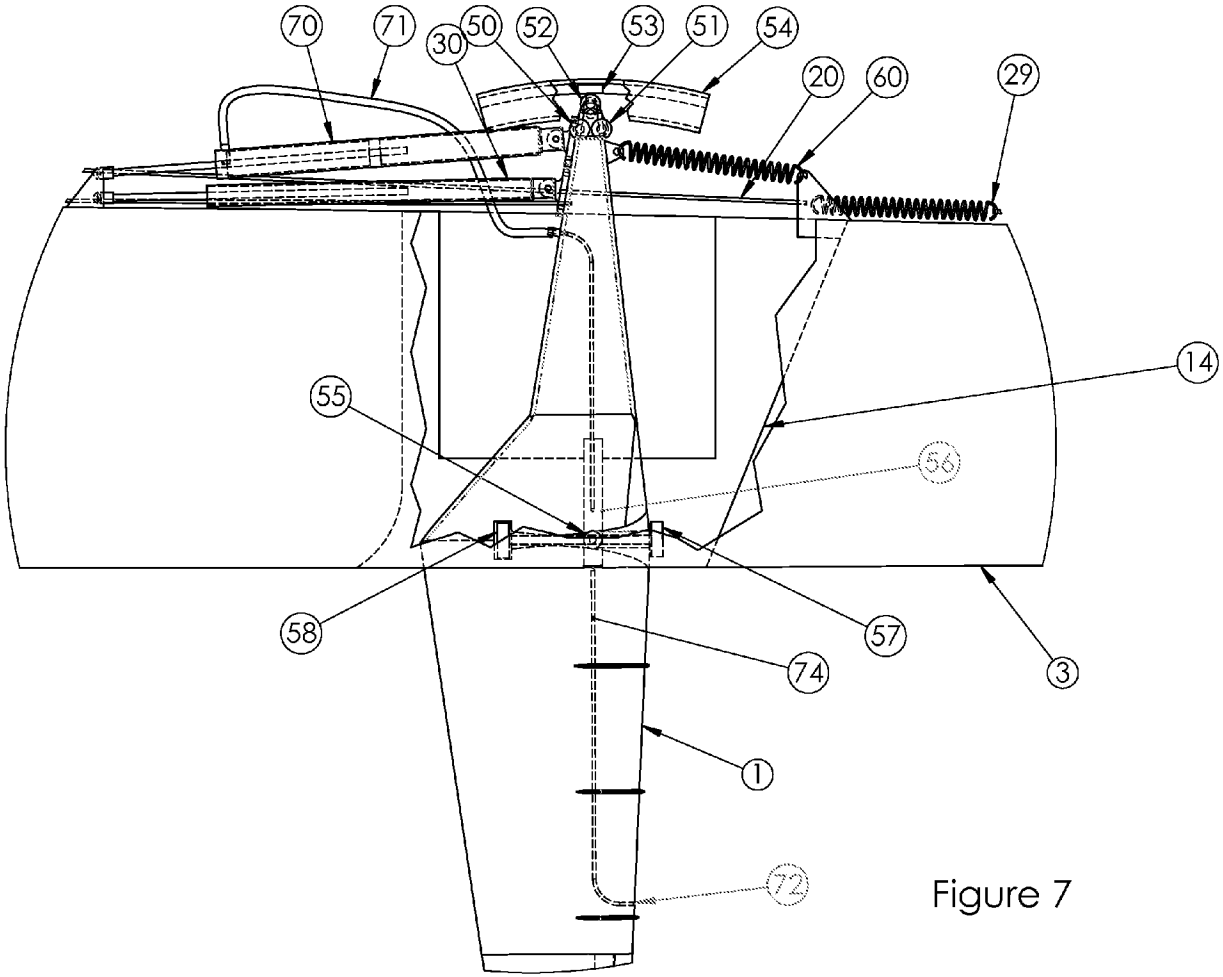
FIG. 7 shows a side view of the hydrofoil in an alternative embodiment.

FIG. 7 shows an alternative embodiment. The hydrofoil 1 is mounted inside dagger board well 14 inside hull 3. Wheels 50, 51, 52 and 53 are attached to the top of the hydrofoil 1 and roll on the circular track 54. Wheels 50 and 51 resist loads in the up direction, wheel 52 resists loads in the down direction and wheel 53 resists loads in the lateral direction. Pin 55 is constrained to track 56. Wheels 57 and 58 resist lateral loads on the hydrofoil at the bottom of hull 3 but allow the hydrofoil 1 to rotate about pin 55.

Spring 60 is attached to the top of the hydrofoil 1 and will be relaxed while the hydrofoil 1 is pitched down. The spring 60 will begin to stretch and produce a negative pitching moment as the hydrofoil 1 pitches up beyond vertical.

Dampener 30 is pivotally attached to the hydrofoil 1 and to the hull 3.

Hydraulic cylinder 70 is pivotally attached to the top of hydrofoil 1 and the hull 3. The hydraulic cylinder 70 is operated by water pressure traveling through tube 71. Water pressure is created by the pitot tube 72 and travels through the hydrofoil 1 through tube 74.

Figure 8:
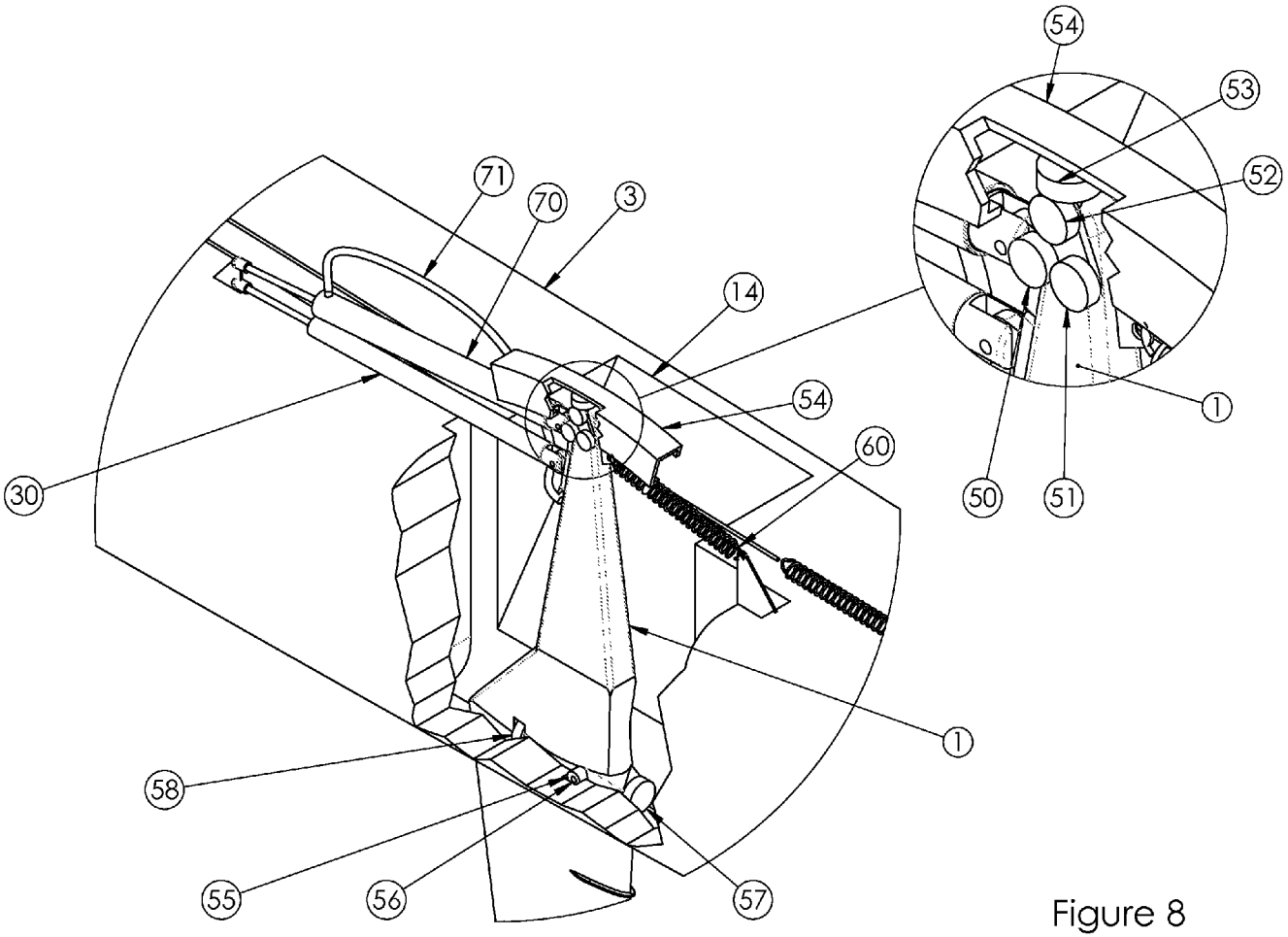
FIG. 8 shows isometric view of the hydrofoil in the alternative embodiment.
Figure 9:
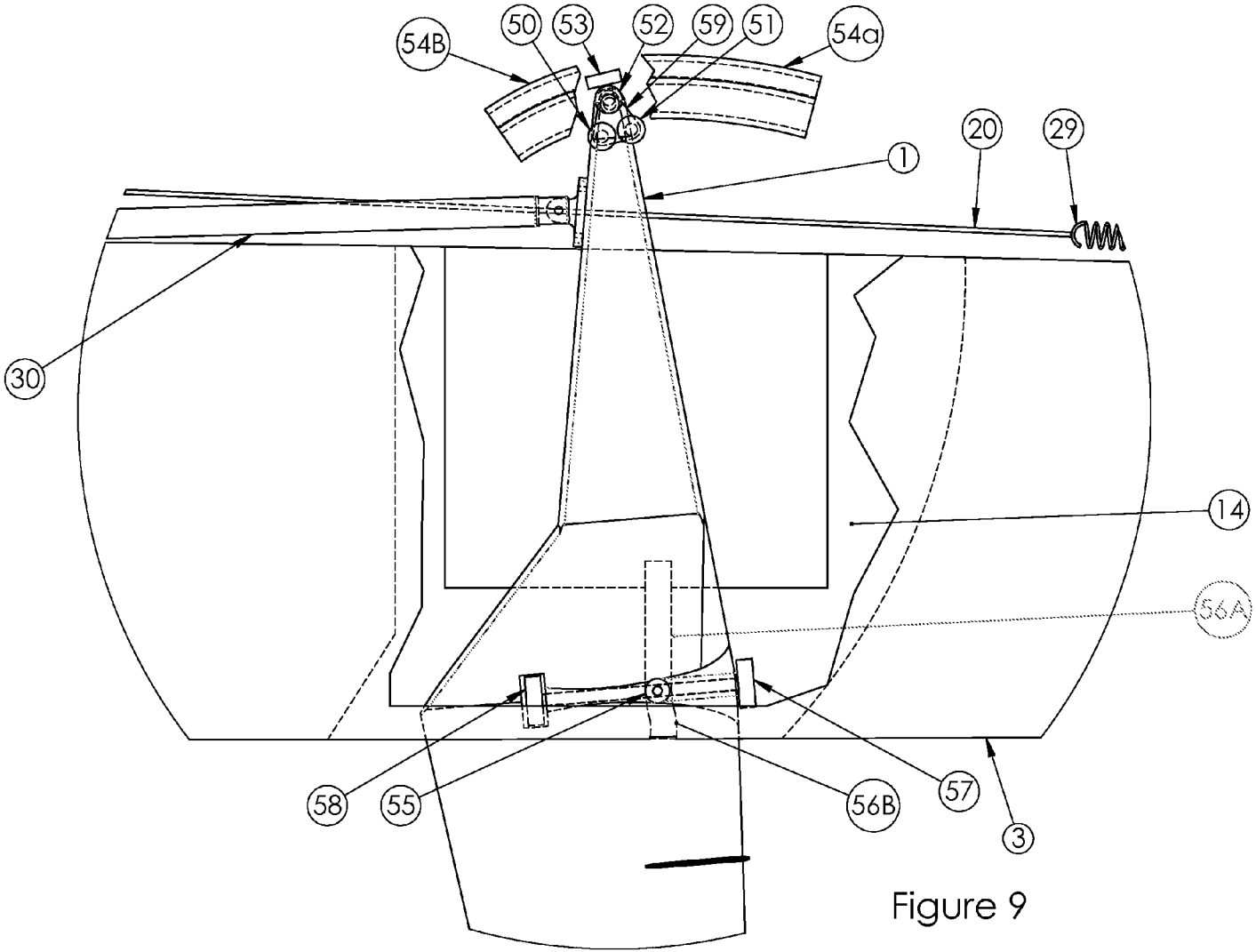
FIG. 9 show a side view of the hydrofoil of a variation of the alternative embodiment.

FIG. 9 shows another embodiment that does not need the spring 60 of FIGS. 7 and 8. Traveler car 59 is pivotally mounted to the top of hydrofoil 1. The traveler car 59 has wheels 50 and 51 to take loads in the up direction, wheel 52 resists loads in the down direction, and wheel 53 resists lateral loads. The wheels 50, 51, 52 and 53 roll on the circular track 54A and 54B. The forward part of circular track 54A has a center of curvature at pin 55 and the rear portion of the circular track 54B has a radius of curvature equal to one half of the forward portion 54A. Pin 55 rotates and translates in track 56A and 56B. When the hydrofoil 1 pitches up and down ahead of vertical the hydrofoil simply pitches, but as the hydrofoil 1 pitches up beyond vertical circular track 54B forces the hydrofoil 1 to pitch and translate. Pin 55 translates in track 56A and 56B. 56B is a curved portion that allows the hydrofoil 1 to move down and forward and allows wheels 57 & 58 to roll smoothly in the dagger board well 14 in hull 3.

What is claimed:

1. A watercraft comprising a hull having a mast with sail, an aft rudder and a hydrofoil projecting below the bottom of the hull, said watercraft further comprising means pivotally connecting each hydrofoil to the hull enabling the said hydrofoil to pitch on a pivot axis which is essentially perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means controlling the angle of incidence of the hydrofoil comprising a trailing sensor arm, said sensor arm being carried on a pivot in proximity to the fore end of the hull, said sensor being dragged behind the pivot, and means connecting said sensor arm to said hydrofoil whereby when the hull is low in the water the sensor arm is constrained to pitch down, and when the hull is too high, the sensor arm pitches up, and when the sensor arm pitches down, the hydrofoil pitches up and when the sensor arm pitches up, the hydrofoil pitches down.

2. A watercraft comprising a hull having a mast with sail, an aft rudder and a hydrofoil projecting below the bottom of the hull, said watercraft further comprising means pivotally connecting each hydrofoil to the hull enabling the said hydrofoil to pitch on a pivot axis which is essentially perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means controlling the angle of incidence of the hydrofoil comprising a trailing sensor arm, said sensor arm being carried on a pivot in proximity to the fore end of the hull, said sensor being dragged behind the pivot, and means connecting said sensor arm to said hydrofoil whereby when the hull is low in the water the sensor arm is constrained to pitch down, and when the hull is too high, the sensor arm pitches up, and when the sensor arm pitches down, the hydrofoil pitches up and when the sehsor arm pitches up, the hydrofoil pitches down, wherein the pivot axis of each hydrofoil is very close to the lift and drag vectors acting on the hydrofoil throughout the range of pitching motion of the hydrofoil.

3. A watercraft comprising a hull having a mast with sail, an aft rudder and a hydrofoil projecting below the bottom of the hull, said watercraft further comprising means pivotally connecting each hydrofoil to the hull enabling the said hydrofoil to pitch on a pivot axis which is essentially perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means controlling the angle of incidence of the hydrofoil comprising a trailing sensor arm, said sensor arm being carried on a pivot in proximity to the fore end of the hull, said sensor being dragged behind the pivot, and means connecting said sensor arm to said hydrofoil whereby when the hull is low in the water the sensor arm is constrained to pitch down, and when the hull is too high, the sensor arm pitches up, and when the sensor arm pitches down, the hydrofoil pitches up and when the sensor arm pitches up, the hydrofoil pitches down, wherein a tension line is attached to the top of the sensor arm and travels back aft of the hydrofoil and rounds a turning block and goes forward and terminates at the top of the hydrofoil, whereby when the sensor arm pitches down the hydrofoil pitches up and conversely when the sensor arm pitches up, the hydrofoil is allowed to pitch down and the angle of attack and the lift generated by the hydrofoil is reduced.

4. The watercraft of claim 3 wherein a spring is in series with said tension line.

5. The watercraft of claim 4 wherein a dampener is operatively connected between said hydrofoil and said hull.

6. A watercraft having a mast with sail comprising a hull having an aft rudder and a hydrofoil projecting below the bottom of the hull, said watercraft further comprising means pivotally connecting each hydrofoil to the hull enabling the said hydrofoil to pitch on a pivot axis which is essentially perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means to cause the hydrofoil to pitch up when the watercraft is closer to the water and to pitch down when the watercraft gains altitude, wherein the hydrofoil rolls on a circular track, the center of the circle defining said pivot axis, the top of the hydrofoil being connected to two wheels that roll on the track, said two wheels being spaced apart so that the track constrains the angle of incidence of the hydrofoil whereby as the wheels roll on the track the hydrofoil is constrained to pitch up or down with the curvature of the track.

7. A watercraft having a mast with sail comprising a hull having an aft rudder and a hydrofoil projecting below the bottom of the hull, said watercraft further comprising means pivotally connecting each hydrofoil to the hull enabling the said hydrofoil to pitch on a pivot axis which is essentially perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means to cause the hydrofoil to pitch up when the watercraft is closer to the water and to pitch down when the watercraft gains altitude, wherein said hydrofoil is further constrained in the lateral direction near the bottom of said hull by rollers which roll in a circular path on smooth surfaces inside said hull.

8. A catamaran having two spaced apart hulls with a deck extending therebetween, each hull having a mast with sail, an aft rudder and a hydrofoil projecting below the bottom of the hull, comprising means pivotally connecting each hydrofoil to each hull of the catamaran enabling the said hydrofoil to pitch on a pivot axis which is perpendicular to the longitudinal axis of the hull, said hydrofoils having a vertical part which produces lateral forces to accelerate the boat in turns and resist lateral forces from the sail, and a vertical portion which curves into the horizontal portion which produces vertical lift, means controlling the angle of incidence of the hydrofoil comprising a sensor arm carrying a trailing sensor, said sensor arm being pivotally carried in proximity to the fore end of the hull, the sensor being pinned to said sensor arm and dragged behind the pivot, whereby the sensor is constrained to stay in contact with the water surface, and means connecting said sensor arm to said hydrofoil whereby when the hull is low in the water the sensor arm is constrained to pitch down, and when the hull is too high, the sensor arm pitches up.

9. The watercraft of claim 1 wherein the watercraft is a catamaran.

10. The watercraft of claim 1 wherein the watercraft is a trimaran.

* * * * *